United States Patent [19]

Lewyt

[11] Patent Number: 4,762,271

[45] Date of Patent: Aug. 9, 1988

[54] COMPARTMENTED AND SEPARABLE MAILING ENVELOPE

[76] Inventor: Alexander Lewyt, 660 Madison Ave., New York, N.Y. 10021

[21] Appl. No.: 540,354

[22] Filed: Oct. 11, 1983

[51] Int. Cl.[4] ..... B65D 27/08

[52] U.S. Cl. ..... 229/72; 229/70

[58] Field of Search ..... 229/70, 72, 73, 68 R, 229/75; 209/569

[56] References Cited

U.S. PATENT DOCUMENTS

| | | | |
|---|---|---|---|
| 211,725 | 1/1879 | Foster | 229/73 |
| 2,001,489 | 5/1935 | Elbaum | 229/73 |
| 2,126,106 | 8/1938 | Goldberg | 206/608 X |
| 2,954,154 | 9/1960 | Mooney | 229/70 |
| 3,040,323 | 6/1962 | Brenner et al. | 209/569 X |
| 3,155,273 | 11/1964 | Cote | 206/611 X |
| 3,167,243 | 1/1965 | Wiley | 229/73 |
| 3,227,360 | 1/1966 | Krueger | 229/73 |
| 3,270,948 | 9/1966 | Donovan | 229/73 |
| 3,531,046 | 9/1970 | Carrigan | 229/72 |
| 3,747,837 | 7/1973 | Wilson | 229/73 |
| 3,791,572 | 2/1974 | Gendron | 229/73 X |
| 3,908,892 | 9/1975 | Pelzer | 229/73 |
| 3,946,938 | 3/1976 | Kranz | 229/73 |
| 3,986,662 | 10/1976 | Luftig | 229/73 X |
| 4,047,661 | 9/1977 | Klein | 229/70 |

FOREIGN PATENT DOCUMENTS

| | | | |
|---|---|---|---|
| 1194056 | 11/1959 | France | 229/70 |

*Primary Examiner*—Stephen Marcus
*Assistant Examiner*—Bryon Gehman
*Attorney, Agent, or Firm*—Kane, Dalsimer, Sullivan, Kurucz, Levy, Eisele and Richard

[57] ABSTRACT

An envelope system is described which is particularly efficient in its manufacture and use. It has particular utility in the marketing field for conducting surveys and like procedures.

The envelope system comprises first and second envelopes integrally joined by a perforated, frangible tear line for separation. The first envelope is formed from a folded planar sheet having a sealable flap for closing the envelope and optionally may have a window for viewing envelope contents. The second envelope, which may be used for returning materials to the sender of the integrated envelopes, comprises a folded, closeable sheet having an aperture for viewing the envelope contents.

15 Claims, 5 Drawing Sheets

FIG. 1
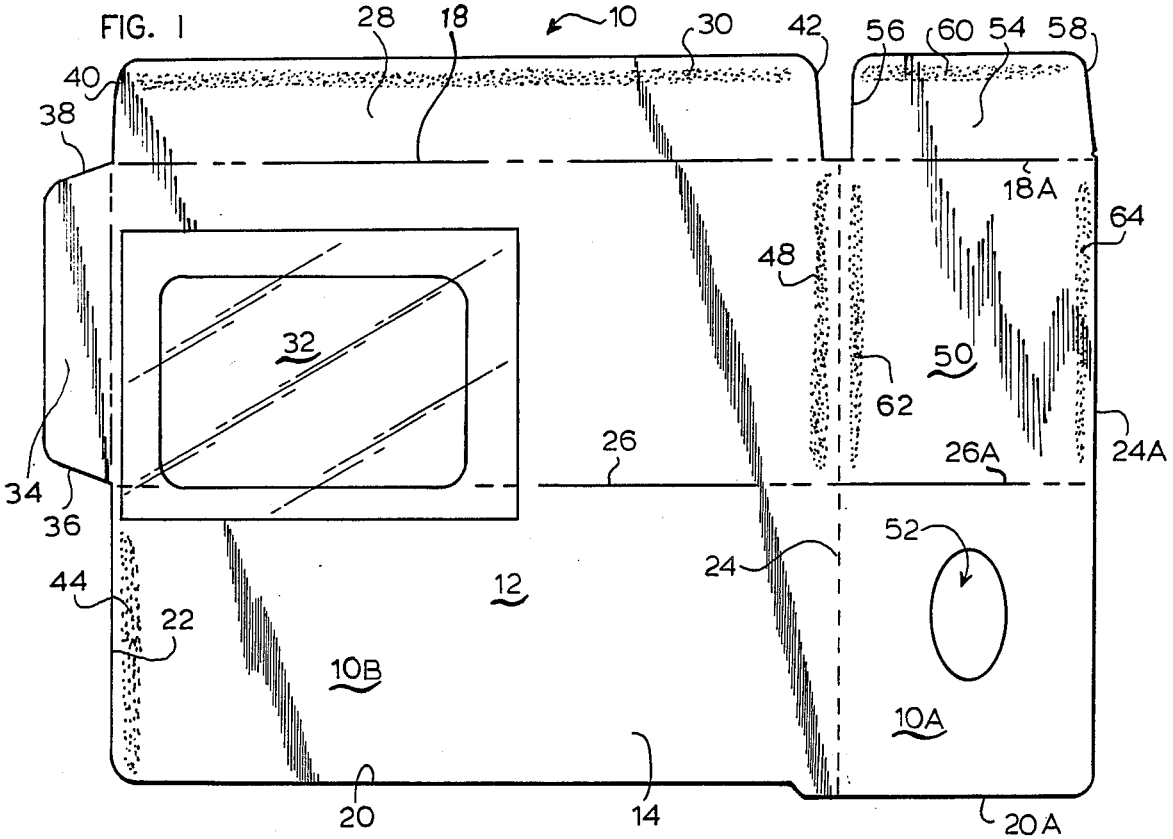
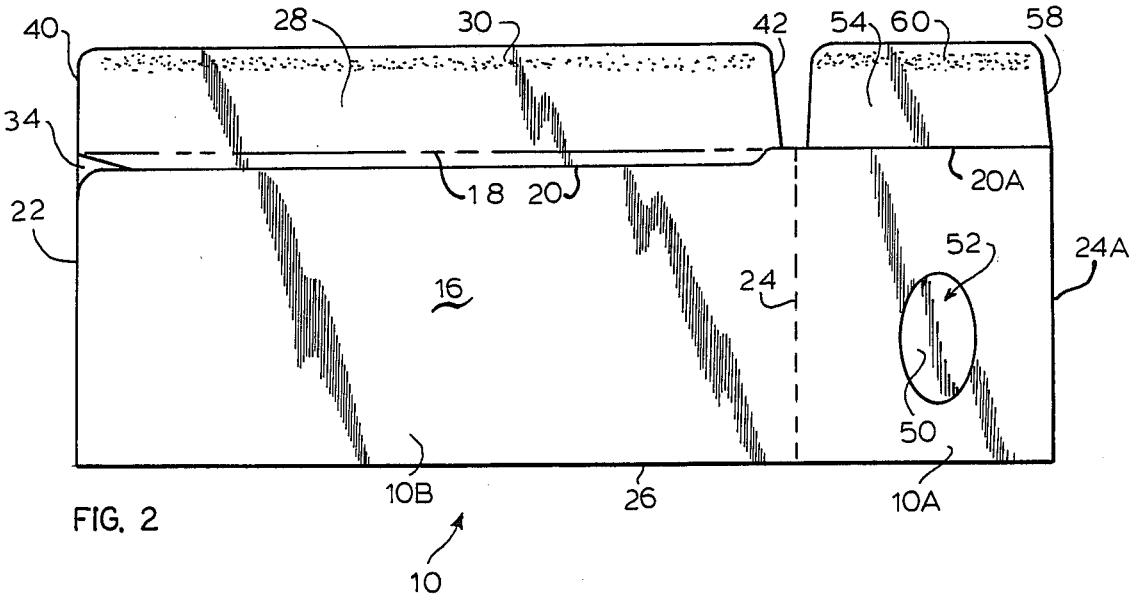
FIG. 2

FIG. 5
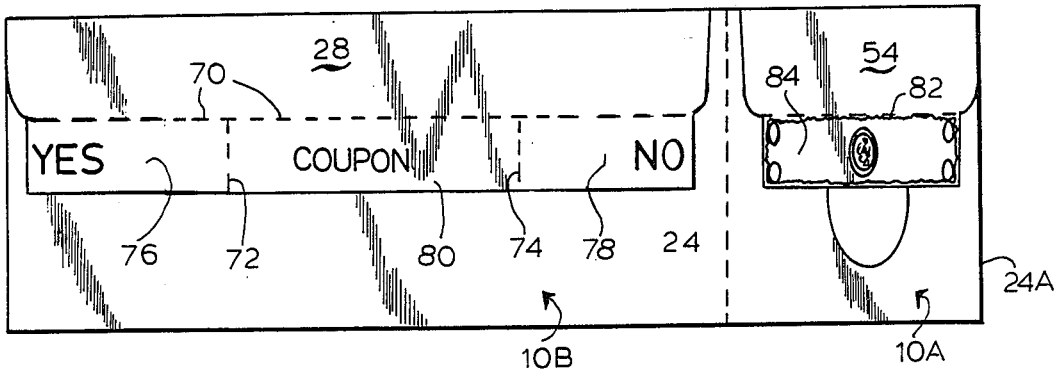
FIG. 6
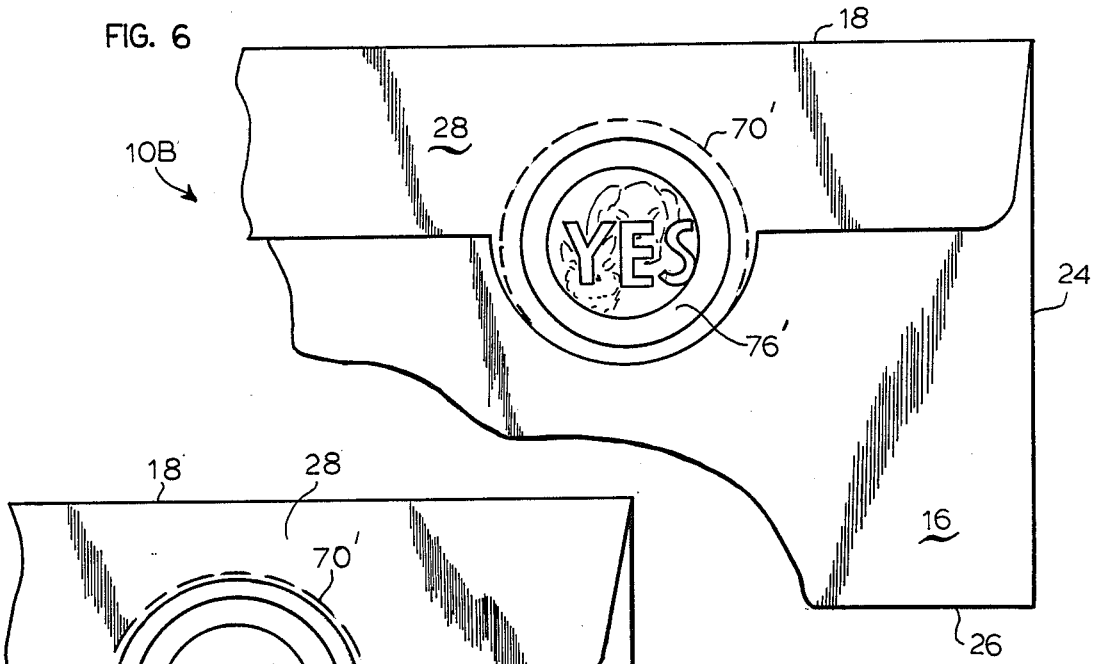
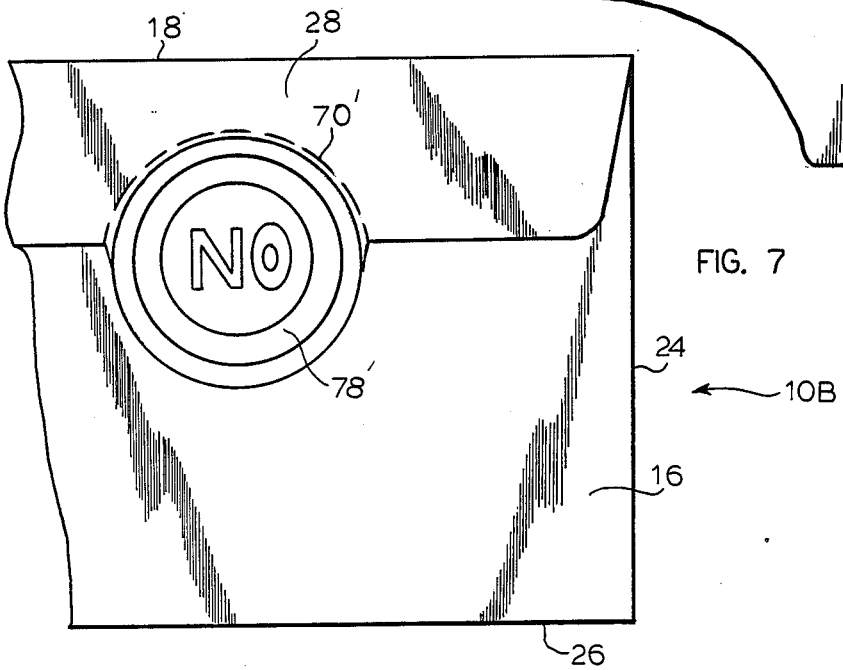
FIG. 7

FIG. 8
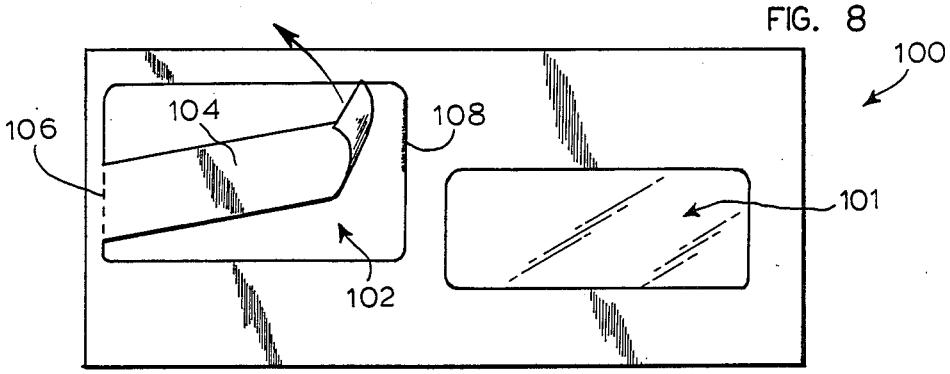
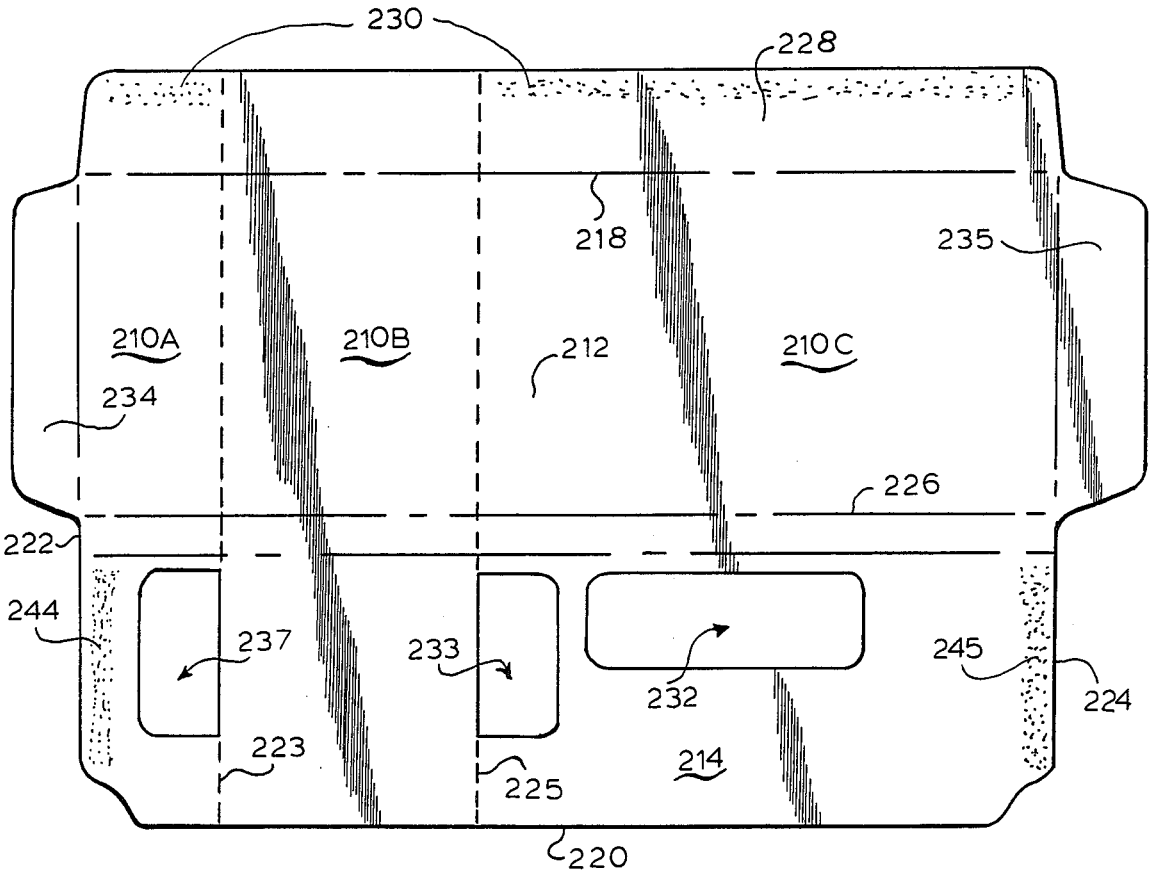
FIG. 9
210

FIG. 10
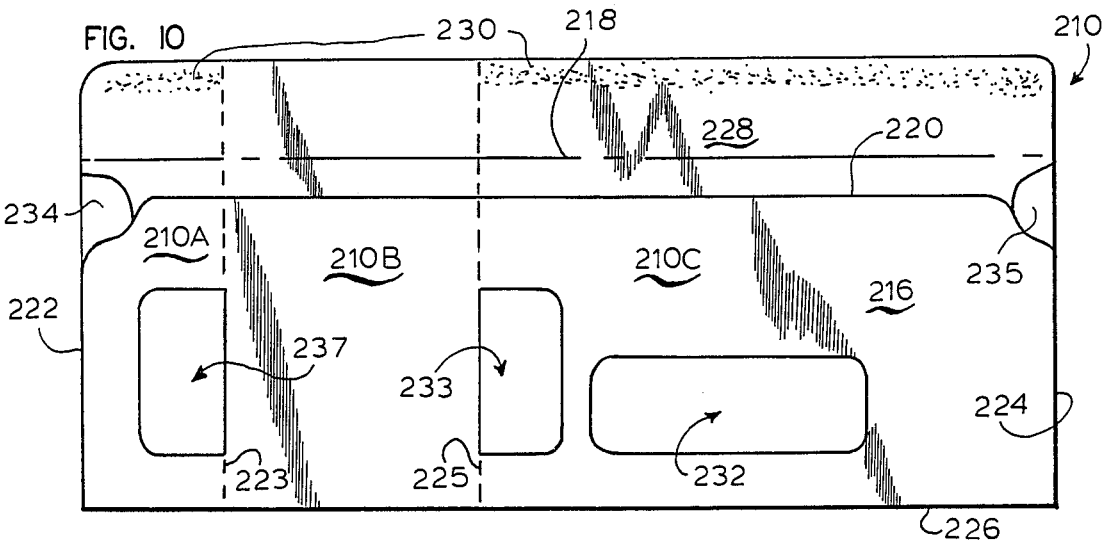
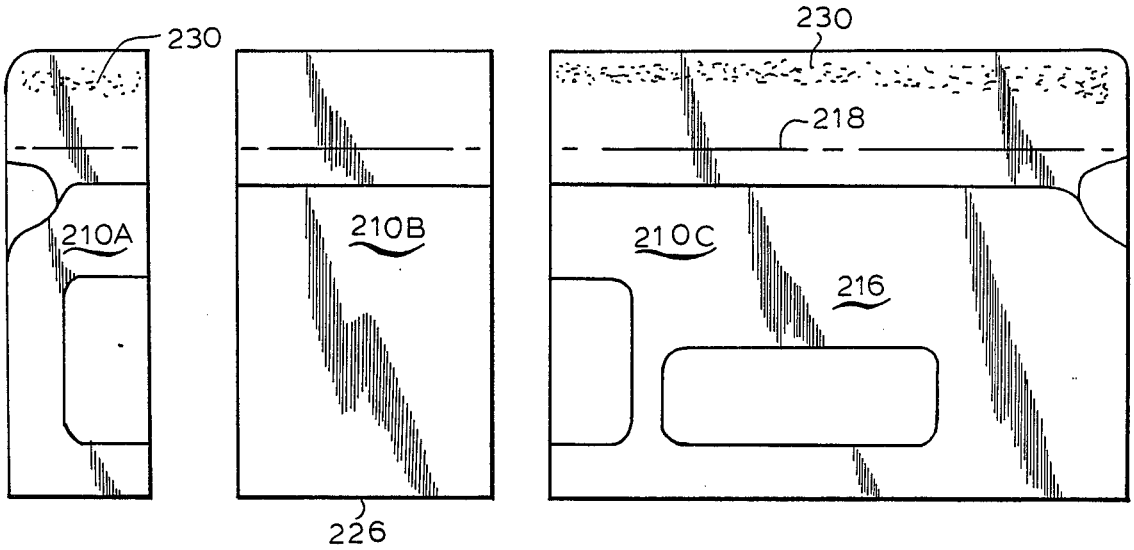
FIG. 11
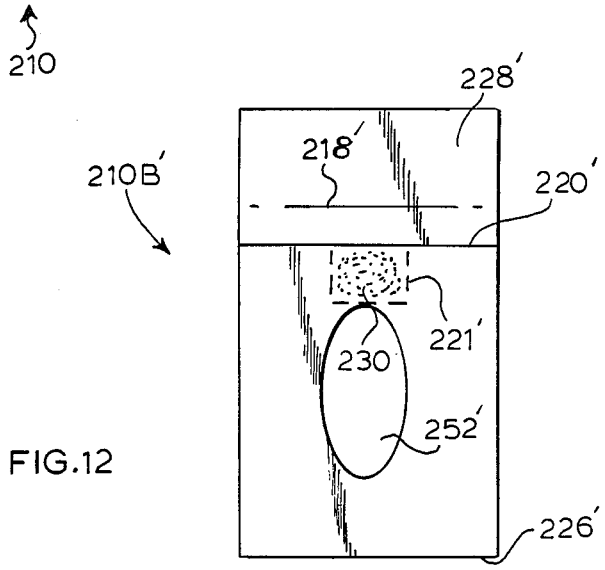
FIG.12

COMPARTMENTED AND SEPARABLE MAILING ENVELOPE

BACKGROUND OF THE INVENTION

Field of the Invention

The invention relates to an improved mailing envelope system and more particularly relates to an improved mailing envelope system which is particularly useful in marketing, soliciting and like promotions.

SUMMARY OF THE INVENTION

The invention comprises a mailing envelope system, which comprises;

(a) a first envelope, which comprises:

1. a sheet having a first inner and a second outer planar surface defined by a top edge, a bottom edge and lateral first and second side edges joining the top and bottom edges, said sheet being folded along a line parallel to top and bottom edges and joining the lateral side edges together, said fold placing the top edge adjacent to the bottom edge and the portion of the lateral edges proximal to the top edge, adjacent to the portion distal to the top edge;
2. a first flap integral with said sheet and extending outwardly from the top edge, adapted by size and configuration to fold over the bottom edge and seal therewith; and
3. optional sealing means on the flap for sealing the first flap to the bottom edge;

(b) a second envelope which comprises;

1. a second sheet having a first and a second planar surface each of which is bounded and defined by a top edge, a bottom edge and lateral first and second side edges joining the top and bottom edges, said sheet being folded along a line parallel to the top and bottom edges and joining the lateral side edges at a point between top and bottom edges, said folded second sheet placing the top edge thereof adjacent to the bottom edge thereof and the portion of the lateral edges proximal to the top edge thereof, adjacent to the portion distal to the top edge thereof;
2. optionally, a flap integral with said second sheet and extending outwardly from the top edge of the second sheet, adapted by size and configuration to fold inwardly and seal with the bottom edge of the second sheet; and
3. optional means on the optional flap of the second sheet, for sealing said flap to the bottom edge of the second sheet when said second sheet is folded;

(c) said first and second sheets being integrally joined to each other along a perforated, frangible tear line between the first edge of the first sheet and one of the lateral side edges of the second sheet; said second envelope being removable from attachment with the first envelope.

The envelope system of the invention is useful as a marketing or soliciting device which can be mailed to a given individual with a request for a response from the recipient. The recipient may separate the first and second envelopes, indicate information desired by the sender on or in the second envelope, insert it within the first or another envelope and return it to the original sender or mail it. One advantage of the system of the invention resides in the facilitation of machine mailing and handling of fewer component parts. The envelope system of the invention is an "involvement device" and as such another advantage is found in a high response rate, i.e., return of information, solicited funds, etc., to the promoter. Further advantages of the mailable envelope system of the invention will be recognized by those skilled in the art, from the further description given below.

BRIEF DESCRIPTION OF THE DRAWINGS

FIG. 1 is a view of an unfolded envelope blank, for assembly of an embodiment system of the invention.

FIG. 2 is a reverse side view of the assemled envelope embodiment shown in FIG. 1, open for insertion of envelope contents.

FIG. 5 shows alternate embodiments of the envelope system shown in FIGS. 1–4.

FIG. 6 shows the large envelope of the envelope embodiment described above, closed, and with alternate embodiment structures.

FIG. 7 is a view as in FIG. 6 showing use of the alternate embodiment structures.

FIG. 8 is a view of further alternate embodiment structures of the envelope system of the invention.

FIG. 9 shows another embodiment envelope system blank of the invention.

FIG. 10 shows the assembled blank of FIG. 9.

FIG. 11 shows the embodiment of FIGS. 9 and 10, disassembled.

FIG. 12 is a front view of one of the alternate components of the envelope embodiments of FIGS. 1–10.

BRIEF DESCRIPTION OF THE PREFERRED EMBODIMENTS OF THE INVENTION

Figure 3:
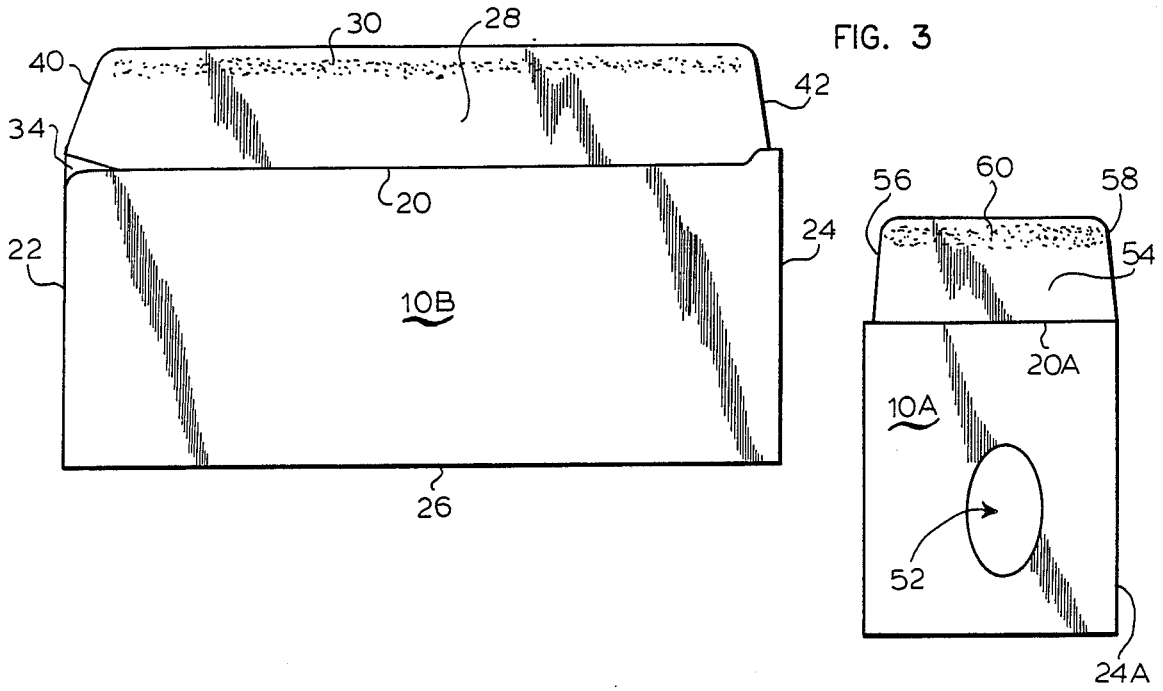
FIG. 3 is a view as in FIG. 2 but with the smaller envelope separated from the larger envelope.

Those skilled in the art will gain an appreciation of the invention by a viewing of the accompanying drawings of FIGS. 1–12, inclusive, together with a reading of the following description.

FIG. 1 is a view of a paper blank for preparing an embodiment envelope system 10 of the invention. Although paper is a preferred material for the assembly of envelope systems 10 of the invention, one is not necessarily restricted to that material. Any flexible, indicia markable material including sheets of synthetic, polymeric resins may be employed alternative to the use of the preferred paper material.

The envelope system 10 is made up of a first sheet 12 having an inner surface 14 and an outer surface 16 (the back side of sheet 12 shown in FIG. 1). The sheet 12 in addition to its planar surfaces 14, 16 is defined and bounded by a top edge 18, a bottom edge 20, a first side edge 22 and a second side edge 24. The side edges 22, 24 join top edge 18 to bottom edge 20. Approximately midway between top edge 18 and bottom edge 20 is a fold line 26 which is perpendicular to edges 22, 24 and roughly divides the sheet 12 into halves. When the halves are folded inwardly towards each other, along fold line 26, a receptacle is formed between the upper and lower inner surface 14 for the receipt of materials desirably transmitted through, for example, the postal system. This receptacle area between the inner surfaces of folded sheet 12 may be viewed in an alternate embodiment envelope system of the invention through a window 32 in the upper half of the sheet 12 as defined by top edge 18 and fold line 26. This window may be open or it may be closed with a transparent film such as a transparent film of cellulose acetate. In normal practice, contents of the receptacle area may include address indicia which is viewable through the window 32. A flap 28 is integral with the sheet 12 and extends outwardly from the top edge 18. An adhesive gum 30 is deposited on the flap 28 as a means for sealing the envelope receptacle area when the sheet 12 is folded along fold line 26. Sealing is effected between the flap 28 and the bottom edge 20 when the envelope system is folded as will be described more fully hereinafter. Integral with the sheet 12 and coextensive with the upper portion of sheet 12 between fold line 26 and edge 18 is a flap 34, extending outwardly from the side edge 22. The flap 34 may be folded inwardly towards the folded sheet 12 to close and seal the folded side edge 22. Sealing of the side edge 22 may be effected by a gum adhesive 44 deposited on a portion of the surface of sheet 12 as shown in FIG. 1, so that when the flap 34 is folded over the folded sheet 12, and sheet 12 is folded over the flap 34, sealing of the edge 22 is effected. In a preferred embodiment envelope system of the invention, the edges 36, 38 of flap 34 are biased inwardly as they extend outwardly from edge 22 so as to make a neat appearance without protruding edges 36, 38. Similarly, the edges 40, 42 of flap 28 may be angled inwardly as they extend outwardly from top edge 18 for the same purpose, i.e to make a neat appearance without protruding edges 40, 42. The second side edge 24 also bears an adhesive gum 48 so that when sheet 12 is folded as described above, the side edge 24 is sealed. When the side edges 22, 24 are closed and sealed as described above, the receptacle zone of the envelope 10B remains open until flap 28 is sealingly engaged with the bottom edge 20 to close the receptacle area. Until so closed, material may be inserted into the partially closed receptacle area of the larger envelope 10B.

A second sheet 50 is formed into a second envelope 10A in a similar manner. That is, the sheet 50 which is an integral and attached extension of sheet 12 bears an extension of fold line 26 in fold line 26A. The extended sheet 50 has a top edge 18A and bottom edge 20A which are joined together by lateral side edge 24A and the second side edge 24 of sheet 12. When folded inwardly along the extended fold line 26A, the side edge 24A is sealed by adhesive 64 and the side edge 24 coextensive with sheet 12 is sealed by the adhesive composition 62. Flap 54 is integral with the sheet 50 and extends outwardly from top edge 18A. Flap 54 bears a sealing means in the form of an adhesive composition 60 which will seal with the bottom edge 20A when folded over the bottom edge 20A. Flap 54 also bears angled side edges 56, 58, angled inwardly as the flap extends outwardly for the purpose of making a neat appearance without a protruding edge. The common edge 24 between adhesive compositions 48, 62 is a semi-perforated tear line facilitating the separation of the folded sheet 12 and the folded sheet extension 50 which will be described more fully hereinafter. An aperture 52 pierces a portion of the extended sheet 50 so that one may view the receptacle area formed by the folded and sealed sheet extensicn 50 (envelope 10A).

FIG. 2 shows the assembled envelope system 10 as viewed from the back side of the envelopes formed by folding and sealing of the side edges 22, 24 and 24A. The flaps 28 and 54 remain unsecured to the bottom edges 20, 20A to facilitate the placement of materials within the receptacles formed by the two envelopes 10A and 10B formed by assembly as described above.

Figure 4:
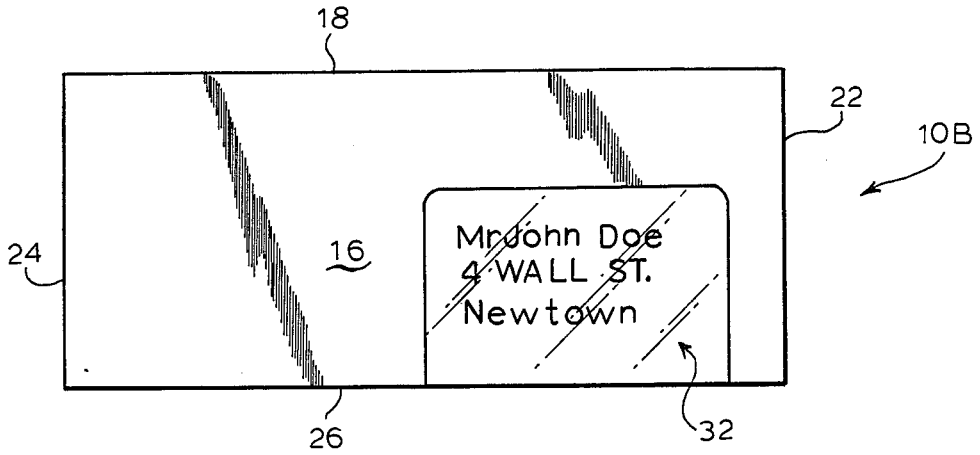
FIG. 4 shows the reverse side of the larger envelope system as shown in FIG. 3, but with the top flap closed.

FIG. 3 is a view as shown in FIG. 2 but with the small envelope 10A separated from the larger envelope 10B by tearing along the semi-perforated, common side edge 24. When so separated, one may, as an example, place monetary currency within the receptacle area of the small envelope 10B and secure it therein by folding over the flap 54 to seal it with the bottom edge 20A. The small envelope 10A is of such a size and configuration that it may be enclosed within the larger envelope 10B and sealed within the receptacle area thereof by folding over flap 28 to seal it with the bottom edge 20. In this way, the enclosed envelope 10A may be mailed within the large envelope 10B to a recipient thereof. The address of the recipient thereof may be inserted in the envelope so that it appears through the window 32 as shown in FIG. 4. Alternatively, when a window 32 is not present, the recipient's address may be imprinted by conventional means upon the reverse side or outer surface 16 of the envelope 10B. In use, the envelope system 10 may be sent to an individual with a solicitation for information, money, etc. The individual may respond to the request by completing a coupon, inserting money into small envelope 10A and returning it to the solicitor in the large envelope 10B or in any other envelope.

FIG. 5 is a view as shown in FIG. 2, but of alternate embodiment envelope systems of the invention having alternate structural features. As shown in the FIG. 5, a tear-off extension is attached to the outer edge of flap 28 along a semi-perforated tear line 70. Removable by tearing off along the tear-off line 70 is a stamp 76 imprinted with the indicia "yes". A similar stamp 78 is removable and bears the imprinted indicia "no". A coupon 80 separates stamp 76 from stamp 78 and bears room for the inclusion of instructions for use and like indicia. The stamps 76, 78 are separable from coupon 80 along respective semi-perforated tear lines 72, 74. Thus, prior to the mailing of the envelope 10B, special instructions and coupons may be separated from the flap 28 for inclusion, for example, in the envelope 10A of envelope 10B. Alternatively, the undersurface of the instructional stamps 76, 78 or coupon 80 may bear an adhesive material so that they may be affixed to the outside of the envelope 10B to facilitate handling by the recipient of the closed and sealed envelope 10B. By positioning of the stamps 76, 78 on the edge of closed flap 28, further security of the sealed envelope 10B is provided. By inclusion or removal of the instructional stamps "yes" or "no", the recipient is given information about the handling procedure to be used in processing the returned envelope 10B. Similarly, a coupon 84 may be removed from the flap 54 by tearing along semi-perforated tear line 82. The coupon 84 may then also be enclosed in envelope 10A or 10B for return to the recipient of the closed envelope 10B. The coupon 84 may also be designed to bear a return address for addressing the return of envelope 10B, and for the purpose may bear an adhesive backing.

FIG. 6 shows another alternative structural feature which may be used in conjunction with the component envelope 10B of the envelope system 10. Thus, a stamp 76' bearing "yes" indicia or like indicia is removable by tearing along the tear line 70' from the envelope 10B. Without removal, the recipient of the envelope 10B is instructed as to how to handle the received letter envelope 10B. As shown in FIG. 7, the stamp 76' has been removed showing an underlying contrary instruction, i.e. in this case a direction of "no" to the recipient. As an example, the "yes" or "no" may indicate whether or not a coupon 84 is enclosed, and the recipient of sealed envelope 10B is thereby informed as to how to handle the envelope 10B received. The underlying instruction may also be printed with a non-reflective color, a magnetic ink or the like to allow for sensing of the instruction with automatic sensing devices. This could eliminate having to visually observe and manually sort received envelopes into the various categories of "yes" or "no".

FIG. 8 shows still another alternate structural embodiment of the invention. Envelope 100 which is an alternate structure for envelope 10B, includes a first transparent window 102 having a tear-off coupon 104, removable by fracturing the semi-perforated tear lines 106 and 108. The removed coupon can bear indicia for one to write in a name, address and like information for inclusion within the envelope 100. A second window 101 can provide a mailing address.

Those skilled in the art will appreciate that many variations may be made of the above described preferred embodiments of the invention without departing from the spirit and scope of the invention. For example, the smaller envelope 10A has been described above as including a flap 54 and optionally an attached coupon 84. The flap 54 is not essential to the invention and may be left off of the envelope system 10. In its absence, the lower edge 20A may be sealed to the underlying folded surface of sheet extension 50 or it may be left open. Similarly, the edge 24A may be left unsealed to the underlying surface of sheet extension 50, in which case the smaller envelope 10A resembles a folded wallet with open edges. Still further, the adhesive composition 62 may be eliminated from the surface of sheet extension 50 so that upon separation of the envelope 10A from envelope 10B, the edge 24 of envelope 10A is also open. The sealing of the side end or top edges of the envelope 10A are not required or necessary although preferred. Articles inserted within the envelope receptacle area of the envelope 10A will not be lost once the smaller envelope 10A is inserted into the larger envelope 10B.

With reference now to the FIGS. 9–12, construction for an envelope system 210 may be seen. In the FIGS. 9–12, structures similar to those found in envelope system 10 are identified by the same numerals, preceded by the integer "2". Thus, the envelope system 210 is bounded by a top edge 218 and a bottom edge 220 and first side edge 222 and second side edge 224. A flap 228 extends outwardly from top edge 218 and bears on portions of its surface an adhesive composition 230. Proximal to the lower edge 220, and adjacent to edge 222 is another deposit of an adhesive composition 244. Opposite the deposit of adhesive 244 of edge 224 is a deposit of adhesive composition 245. When folded along fold line 226 which is approximately midway between edges 218 and 220, with the flaps 234 and 235 folded inwardly, the adhesive compositions 244 and 245 secure the ends 222 and 224 closed, so that a receptacle area is formed between the folded sheet 212 as shown in FIG. 10. Envelope contents may be inserted within the receptacle area of the folded envelope 210 as shown in FIG. 10, while the flap 228 is in an open position. The envelope 210 can be sealed closed by folding down flap 228 and sealing with the sealant composition 230 against the sheet 212 adjacent to edge 220.

The sheet 212 of envelope 210 also includes an aperture 232 for viewing contents of the closed envelope therethrough. Apertures 233 and 237 also permit a viewing into the receptacle area of the closed envelope 210. It will be observed also that semi-perforated lines 223 and 225 separate the apertures 233 and 237 and also subdivide the sheet 212 into envelope components 210A, 210B and 210C. The flap 228 portion of the envelope 210 does not have glue thereon in the subdivided portion 210B, for purposes which will be described more fully hereinafter.

Following the delivery of the envelope 210 to a recipient, containing enclosures thereof, the envelope 210 may be opened to remove the contents thereof. Opening of the envelope involves the recipient. The envelope 210 may be separated or subdivided into its component portions 210A, 210B and 210C as shown in FIG. 11, by tearing along the semi-perforated lines 223 and 225. Upon disassembly into parts 210A, 210B and 210C the envelope contents are removable. The portions 210A and 210C may be discarded, leaving the portion 210B which may be, for example, a promotional device or souvenir to be retained by the recipient of the envelope system 210. In a preferred embodiment of the invention, the portion 210B may constitute a coupon, a survey device or like material with instructions for the recipient thereof to complete with, for example, a name and/or address for return to the original sender of the envelope system 210. In this way, promotional and/or marketing information may be obtained by the original sender, from the envelope recipient. The portion 210B may also be used as a wrapper to enclose currency, checks, etc., for sending to the promotor or another party.

FIG. 12 is a side view of an alternate embodiment portion 210B, identified as 210B'. In the FIG. 12, parts corresponding to those found in the component 210B are identified by like indicia followed by a prime symbol. In the embodiment of FIG. 12, a portion of the envelope portion 210B' along edge 220' is bounded by a semiperforated bent line 221'. This portion bounded by perforated line 221' may bear on its surface an adhesive composition 230' for sealing the folded down portion of flap 228'. Alternatively, the self-sealing adhesive 230' may be positioned on the flap 228' at a location opposite the portion bounded by line 221'. Upon lifting the sealed down flap 228', that portion of the portion 210B' delineated by the semi-perforated line 221' would readily tear away to facilitate the unfolding and use of the portion 210B'.

As described above, the various embodiment envelopes of the invention facilitate the use of various mechanical means of handling mail. For example, if the recipient of the envelope system 10 responds thereto by sending back the smaller envelope 10A to the original sender or promoter, with money or a like response, containment in the smaller envelope 10A facilitates handling by mechanized means. Sensing devices may be employed to identify the contained article so that the returned envelopes 10A may be sorted according to their contents. More specifically, sensing devices can detect the magnetic ink commonly employed on checks or like negotiable instruments. Detection can be made without opening the envelope 10A. In this way, one can sort negotiable checks and like instruments bearing magnetic ink indicia from, for example, empty envelopes 10A or envelopes 10A containing currency such as dollar bills. In this way, sorting of the received envelopes 10A is facilitated.

What is claimed:

1. A mailing envelope system, which comprises;

(a) a first envelope, which comprises:

1. a sheet having a first inner and a second outer planar surface defined by a top edge, a bottom edge and lateral first and second side edges joining the top and bottom edges, said sheet being folded along a line parallel to the bottom edge and joining the lateral side edges together, said fold placing the top edge adjacent to the bottom edge and the portion of the lateral edges proximal to the top edge, adjacent to the portion distal to the top edge; sealing means inwardly along the first edge, sealing the first edge above the fold to the first edge below the fold;
2. a first flap integral with said sheet and extending outwardly from the top edge, adapted by size and configuration to fold over the bottom edge and seal therewith;
3. sealing means on the flap for sealing the top edge to the bottom edge; and
4. means for closing the second side edge extending from the top edge to the fold with the second side edge extending from the fold to the bottom edge;

(b) a second envelope which comprises;

1. a second sheet having a first and a second planar surface each of which is bounded and defined by a top edge, a bottom edge and lateral first and second side edges joining the top and bottom edges, said sheet being folded along a line parallel to the top and bottom edges and joining the lateral side edges at a point between top and bottom edges, said folded second sheet placing the top edge thereof adjacent to the bottom edge thereof and the portion of the lateral edges proximal to the top edge thereof, adjacent to the portion distal to the top edge thereof; an aperture in the second sheet between the bottom edge thereof and the line parallel to top and bottom edges thereof;
2. a flap, integral with said second sheet and extending outwardly form the top edge of the second sheet, adapted by size and configuration to fold inwardly and seal with the bottom edge of the second sheet;
3. means on the flap of the second sheet, for sealing said flap to the bottom edge of the second sheet when said second sheet is folded; and
4. means sealing the lateral side edges of the second sheet, above the line of the second sheet to the lateral side edges of the second sheet below the line of the second sheet;

(c) said first and second sheets being integrally joined to each other along a perforated, frangible tear line between the first edge of the first sheet and one of the lateral side edges of the second sheet; said second envelope being removable from attachment with the first envelope.

2. The system of claim 1 wherein said first and second envelopes are fabricated of paper.

3. The system of claim 1 having a window in the sheet of the first envelope, between the top edge and the fold line.

4. The system of claim 3 wherein the window is closed with a transparent film.

5. The system of claim 3 wherein a second window is in the sheet of the first envelope.

6. The system of claim 1 having an extension on the outer edge of the first flap on the first envelope, said extension being attached to the first flap along a frangible line.

7. The system of claim 6 wherein the extension bears informative indicia.

8. The system of claim 7 wherein the extension bears a deposit of an adhesive composition.

9. The system of claim 7 wherein the extension covers indicia on the underlying sheet of the first envelope.

10. The system of claim 7 wherein the indicia is of a character which may be sensed by automatic sensing devices.

11. The system of claim 6 wherein the extension is sub-divided by at least one frangible tear line.

12. The system of claim 1 wherein there are first and second windows in the sheet of the first envelope.

13. The system of claim 12 wherein there is a removable bridge across the first window.

14. The syteme of claim 1 wherein the first envelope contains the separated second envelope.

15. The system of claim 1 wherein the first envelope (a) further comprises;

5. a second flap on the second side edge integral with said sheet and extending from the top edge to the fold; and
6. sealing means positioned on the sheet for sealing said second flap to said folded sheet.

* * * * *